US007502605B2

(12) United States Patent
Castiglione et al.

(10) Patent No.: US 7,502,605 B2
(45) Date of Patent: Mar. 10, 2009

(54) SUB-MILLIMETER WAVELENGTH CAMERA

(75) Inventors: Dario Calogero Castiglione, Reading (GB); Luisa Deias, Cagliari (GB); Inigo Ederra-Urzainqui, Isaba (ES); David Brian Haskett, Castletroy (IE); Derek Jenkins, Wantage (GB); Alexandre Vincent Samuel Bernard Laisne, Vains (FR); Alec John McCalden, Farncombe (GB); James Peter O'Neil, Sheffield (GB); Jorge Teniente-Vallinas, Lodosa (ES); Frank Van De Water, Waalre (NL); Alfred A. Zinn, Seeheim-Jugenheim (DE); Peter De Maagt, Katwijk (NL); Chris Mann, St Mawgan (GB)

(73) Assignee: Agence Spatiale Europeenne, Paris (FR)

( * ) Notice: Subject to any disclaimer, the term of this patent is extended or adjusted under 35 U.S.C. 154(b) by 370 days.

(21) Appl. No.: 10/532,736

(22) PCT Filed: Oct. 27, 2003

(86) PCT No.: PCT/EP03/13342

§ 371 (c)(1),
(2), (4) Date: Apr. 25, 2005

(87) PCT Pub. No.: WO2004/038854

PCT Pub. Date: May 6, 2004

(65) Prior Publication Data

US 2006/0111619 A1 May 25, 2006

(30) Foreign Application Priority Data

Oct. 25, 2002 (GB) ..... 0224912.6

(51) Int. Cl.
*H01Q 21/06* (2006.01)
*B44C 1/22* (2006.01)

(52) U.S. Cl. ..... 455/313; 455/316; 455/318; 455/333; 455/76; 455/77; 216/13; 216/33; 216/41; 216/49; 216/51

(58) Field of Classification Search ..... None
See application file for complete search history.

(56) References Cited

U.S. PATENT DOCUMENTS

| | | | | |
|---|---|---|---|---|
| 4,607,394 | A * | 8/1986 | Nightingale | 455/327 |
| 6,229,411 | B1 | 5/2001 | Mann | |
| 6,323,818 | B1 * | 11/2001 | Koh et al. | 343/786 |
| 6,404,402 | B1 * | 6/2002 | Koh et al. | 343/786 |
| 6,522,304 | B2 * | 2/2003 | Ballantine et al. | 343/772 |

FOREIGN PATENT DOCUMENTS

WO WO 98/42486 * 10/1998

OTHER PUBLICATIONS

V. Lubecke, et al., "Micromachining for Terahertz Applications", IEEE Transactions on Microwave Theory and Techniques, vol. 46. No. 11, Nov. 1998, pp. 1821-1831.

(Continued)

*Primary Examiner*—Anita K Alanko
(74) *Attorney, Agent, or Firm*—Clarke & Brody

(57) ABSTRACT

The invention relates to an imaging device to be used with millimeter and/or sub-millimeter radiation comprising at least a pair of substrates, at least one of which is patterned on at least one surface with a patterning defining at least one radiation detector, each radiation detector comprising: an antenna adapted to receive millimeter and/or sub-millimeter electromagnetic radiation, a mixer channel coupled to said antenna and in communication with a via extending through a substrate for connection to a signal output, a mixer comprising filters being mounted in the mixer channel for extracting an intermediate frequency signal in dependence upon said radiation received by the antenna, a waveguide structure coupled to said mixer and having a signal input for connection to a local oscillator.

13 Claims, 7 Drawing Sheets

OTHER PUBLICATIONS

P. De Maagt, et al., "Integrated Antenna Technology for Millimetre and Sub-Millimetre Waves", Preparing for the Future, ESA, Noordwijk, NL, vol. 8, No. 2, Jun. 1, 1998, pp. 18-19.

C. Mann, et al., "Invited—Microfabrication of 3D Terahertz Circuitry", 2003 IEEE MTT-S Int'l. Microwave Symposium Digest, Philadelphia, PA, Jun. 8-13, 2003, pp. 739-742.

* cited by examiner

SUB-MILLIMETER WAVELENGTH CAMERA

BACKGROUND OF THE INVENTION

The present invention relates to a sub-millimeter wavelength imaging device and particularly but not exclusively to an ambient temperature camera using either single or multiple heterodyne detectors.

The terahertz electromagnetic spectrum extends over a range of frequencies where radio waves and optical waves merge and consequently the detection of terahertz radiation utilises a mixture of optical and radio wave technology. As a result of the dimensions of the individual components required to image at terahertz frequencies, the cost of terahertz imaging systems has generally been prohibitive.

However, terahertz frequencies have long been recognised as potentially extremely useful frequencies for imaging purposes as many materials which are opaque in the visible region of the spectrum become transparent to terahertz waves. In particular imagers at terahertz frequencies are suitable for imaging the Earth's surface as most weather conditions such as fog are transparent to terahertz waves. This also makes a terahertz imager a potentially useful imaging device when flying a plane or driving a land vehicle in bad weather, for example. The transparency of many materials to terahertz frequencies has also been identified as a useful tool for security purposes. Most notably clothing becomes transparent at these frequencies enabling hidden weapons worn under clothing to be seen clearly and for spotting people hidden in canvas sided trucks and lorries. Furthermore, In view of the fact that human bodies radiate at these frequencies, terahertz radiation has also been identified as a potentially powerful diagnostic tool for example in the early detection of skin cancers. Also, applications of terahertz imaging in the chemical and food industries have been identified, for example in the detection of one or more constituents each having different transmissive/reflective properties at these frequencies.

BRIEF SUMMARY OF THE INVENTION

The present invention therefore seeks to provide an imaging device capable of detecting low power passive terahertz radiation and of operating at ambient temperatures, in sub-millimeter (i.e. terahertz) and/or millimeter wavelength range.

Accordingly the present invention provides a imaging device to be used with millimeter and/or sub-millimeter radiation comprising at least a pair of substrates, at least one of which is patterned on at least one surface with a patterning defining at least one radiation receiver, each radiation detector comprising:

- an antenna adapted to receive millimeter and/or sub-millimeter electromagnetic radiation,
- a mixer channel coupled to said antenna and in communication with a via extending through a substrate for connection to a signal output, a mixer comprising filters being mounted in the mixer channel for extracting an intermediate frequency signal in dependence upon said radiation received by the antenna.
- a waveguide structure coupled to said mixer and having a local oscillator signal input for connection to a local oscillator.

In a preferred embodiment the pair of substrates have patterning defining in combination a plurality of antennae with respective mixing channels and local oscillator waveguide structures. Also, one of the pair of substrates may be patterned on opposed surfaces and the imaging device may further comprise a third substrate patterned on one of its surfaces such that the three substrates co-operably define by means of their patterning two rows of antennae and respective mixing channels and local oscillator waveguide structures.

In a further preferred embodiment the patterning of the substrates describe the mixing channel intersecting the local oscillator waveguide structure at an acute angle.

In a preferred embodiment the imaging device has a plurality of imaging pixels for increased imaging resolution and is capable of generating multiple colour images.

The present invention also provides a method of fabricating a three dimensional structure in a substrate comprising applying to a surface of the substrate a plurality of differently patterned masks directly on top of one another and thereafter etching through a mask and then removing the mask before repeating the process for each of the remaining masks. To that effect, the invention relates to a process for making a substrate for an imaging device, comprising the following steps:

- providing on a surface of a substrate a first, a second and a third patterned masks, said first mask having a first pattern corresponding to a first region of each radiation detector with the highest etch depth, said second mask having a second pattern corresponding to said first region and to a second region of each radiation detector with an intermediate etch depth, and said third mask having a third pattern corresponding to said first and second regions and to a third region of each radiation detectors with the shallowest etch depth.
- performing a first etch through the first pattern of the first mask at a first depth that is substantially equal to the difference between the highest etch depth and the intermediate etch depth.
- removing said first mask
- performing a second etch through the second pattern of the second mask at a second depth that is substantially equal to the difference between the intermediate etch depth and the shallowest etch depth.
- removing said second mask
- performing a third etch through the third pattern of the third mask with an etch depth that is substantively equal to the shallowest etch depth.

BRIEF DESCRIPTION OF THE DRAWINGS

An embodiment of the present invention will now be described by way of example only with reference to the accompanying drawings, in which.

DETAILED DESCRIPTION OF THE INVENTION

Figure 1:
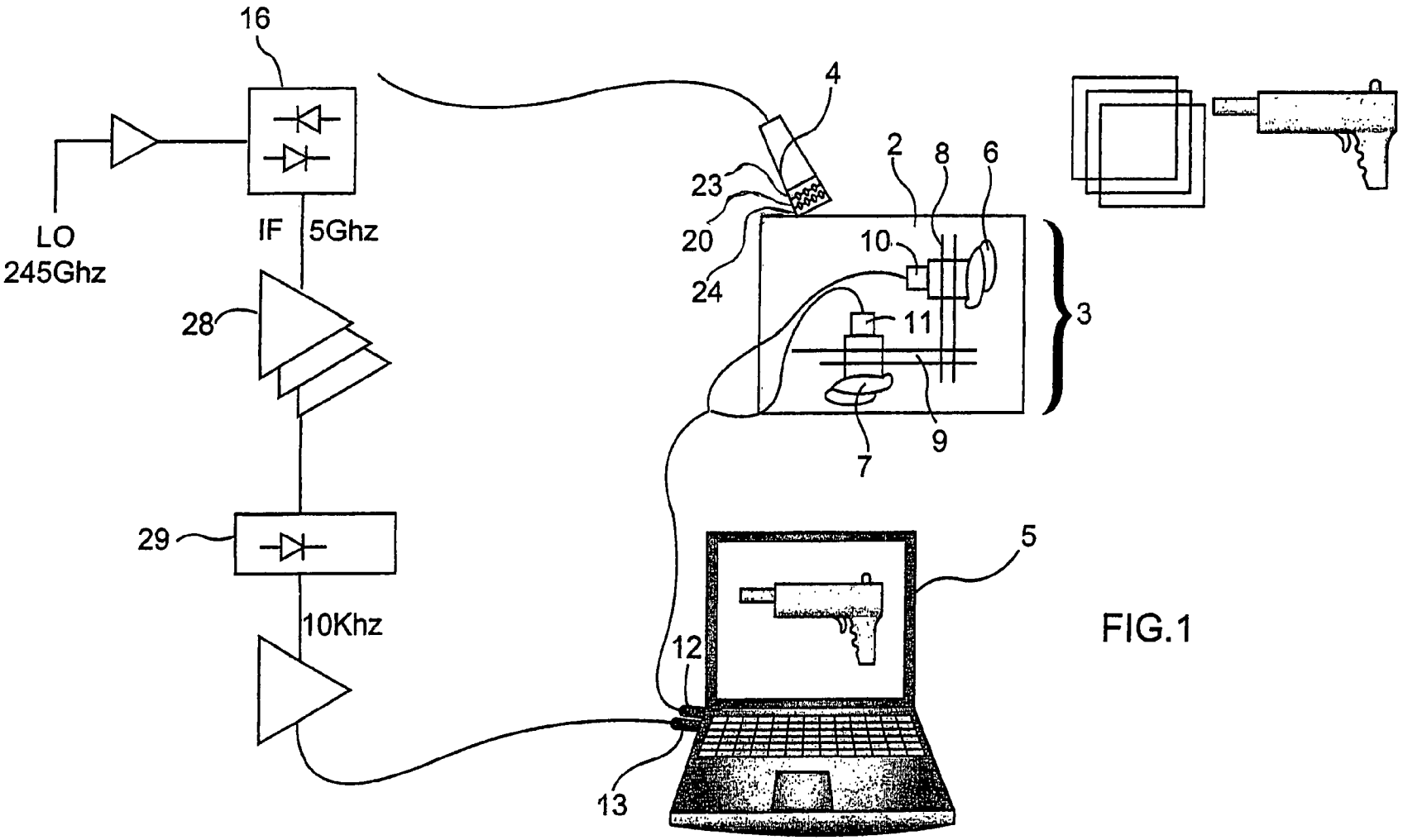
FIG. 1 is a schematic diagram of a two-colour terahertz camera in accordance with the present invention.

The terahertz camera 1 of FIG. 1 comprises an X-Y stage 2 on which are mounted the scanning optics 3 and the terahertz detector 4 and a processor 5. The arrangement of the scanning optics 3 is conventional and comprises a plurality of mirrors 6, 7, e.g. planar or parabolic or hyperbolic. Each mirror 6, 7 is movably mounted on respective orthogonal tracks 8, 9 and arranged to direct incident radiation from a specimen on a fixed specimen support (not illustrated) to the terahertz detector 4. Relative movement of the two mirrors 6, 7 on their tracks thus enables the specimen to be scanned in orthogonal directions. The scanning may be effected otherwise, e.g. by means of rotating or flipping mirrors.

It will, of course, be appreciated that the mirrors 6, 7 should exhibit a high reflectivity to the particular radiation in order to minimise losses especially where passive radiation of a specimen is being imaged as the power of such radiation can be of the order of $10^{-12}$ W.

With the embodiment of a terahertz camera illustrated in FIG. 1, movement of the two mirrors 6, 7 is controlled by separate linear motors 10, 11, which may be stepper motors to ensure precise positioning of the mirrors in the X-Y plane. Each of the motors 10, 11 includes a data port 12 that is connected to the processor 5 and feeds data on the instantaneous positions of the mirrors, and also receives control signals from the computer. As previously stated, flipping mirrors or the like may be use for scanning.

Figure 2:
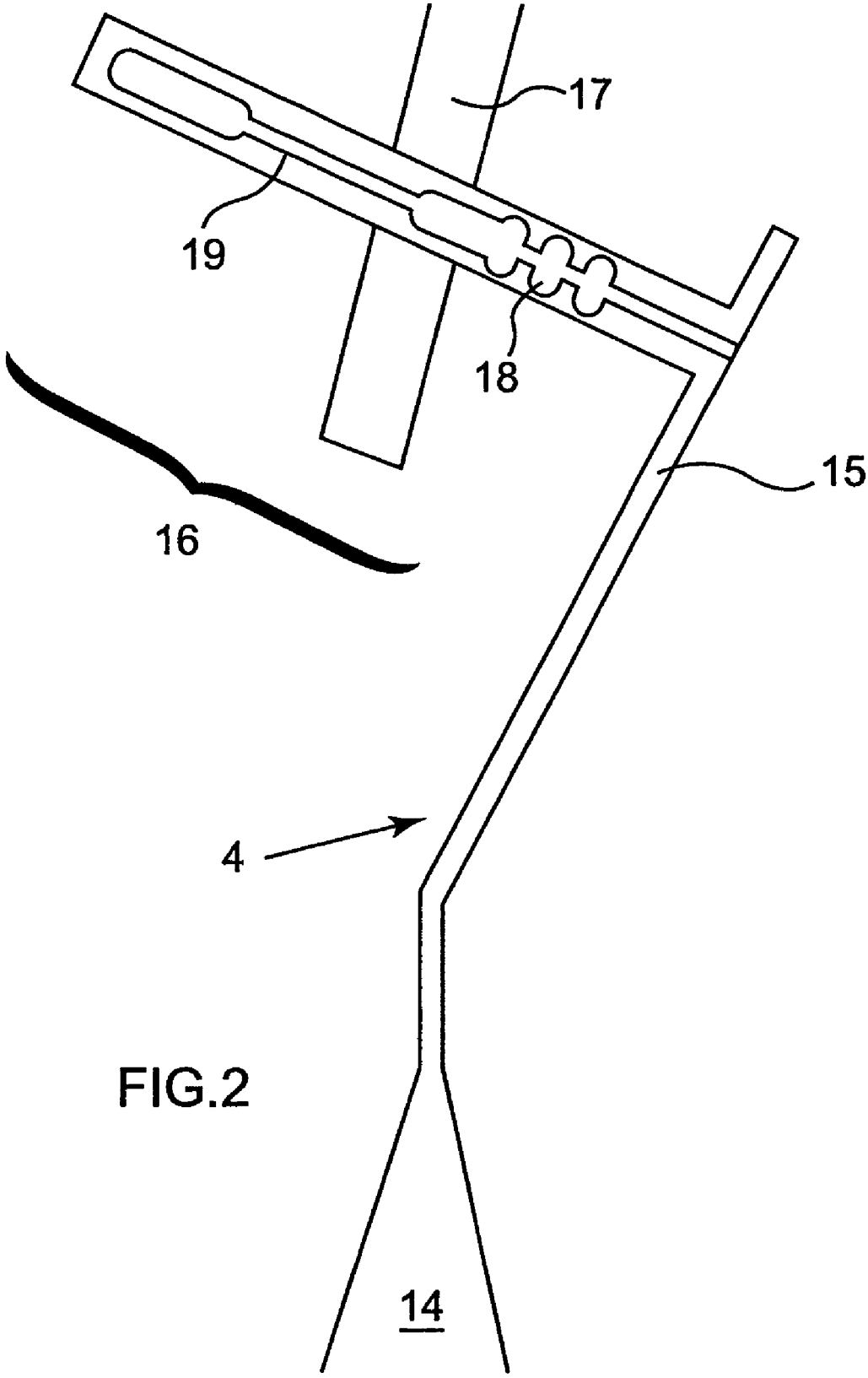
FIG. 2 is an enlarged view of the detector of the terahertz camera of FIG. 1.
Figure 3:
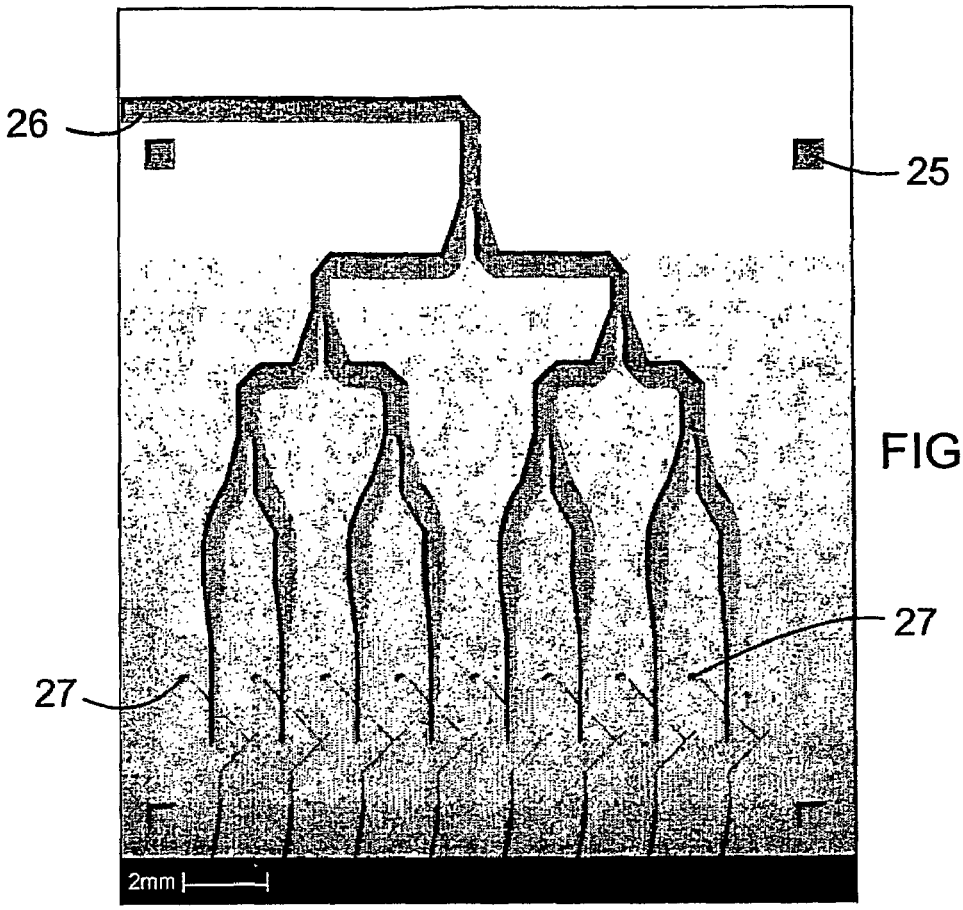
FIG. 3 is a photographic plan view of the waveguide structure employed in the terahertz camera of FIG. 1.
Figure 4:
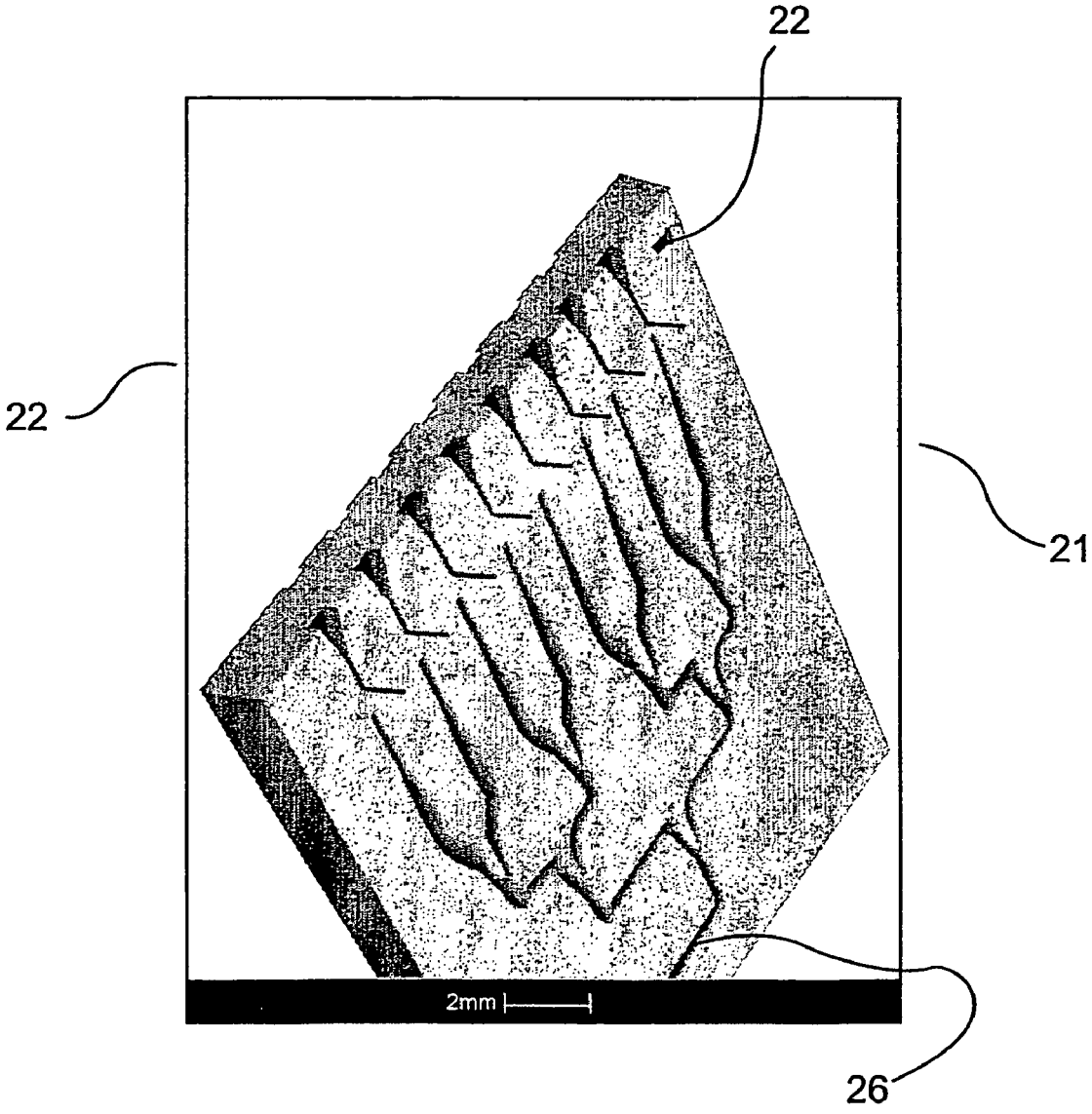
FIG. 4 is a photographic perspective view of the waveguide structure of FIG. 2 illustrating the double-sided etching of the waveguide structure.

The terahertz detector 4 is coupled to an intermediate frequency IF electronic circuit 28 and to a baseband electronic circuit 29 which has an output data port 13 in communication with the processor 5. The processor 5, which is preferably a conventional desktop or portable computer, receives and synchronises the image data from the detector 4 and the positional data from the drivers of the motors 10, 11 and builds from the data an image of the scanned specimen. Conventional data acquisition software may be used for this purpose. This image may be displayed on a screen and/or output to a printer as well as being stored as a conventional file. In FIG. 2, the terahertz detector 4 is illustrated in detail. Its components are fabricated in or are mounted on a semi-conductor, e.g. silicon structure an example of which is illustrated in FIGS. 3 and 4. Alternatively, a metallic structure may be used. The components of the detector 4 comprise an antenna comprised of a horn antenna 14 and a waveguide 15, a mixer 16 and a local oscillator feed 17. The antenna selectively receives a predetermined frequency of electromagnetic radiation ("signal input"), the waveguide 15 being in communication with a mixer 16 which is also in communication with a local oscillator feed 17 comprised of a waveguide structure and having a signal input for connection to a local oscillator. The mixer 16 heterodynes the signal input and the local oscillator input so as to generate an intermediate frequency ("IF") output. In other words, in this embodiment of an IF signal is generated in the detector rather than outside as in FIG. 1. The mixer 16 includes on a microstrip a first pass band filter 18 for isolating the local oscillator input from the waveguide 15 and a second pass band filter 19 which acts as a back stop to allow through only the pre-selected IF output.

As can be seen in the Figures, the mixer 16 is arranged so as to be substantially orthogonal to the waveguide 15. However, the intersection of the axis of the mixer 16 with the axis of the local oscillator feed 17 is not orthogonal and instead describes an acute angle. This arrangement of the local oscillator feed 17 at an acute angle to the mixer 16 reduces the back short length over a wider band width and so improves the bandwidth of the mixer transition in comparison to the more conventional 90° arrangement. Moreover, this arrangement of the local oscillator input 17 and the mixer 16 provides an added benefit particular to imaging systems at these frequencies. It reduces the space occupied by each detector, thereby allowing them to be placed closer and a larger number of them, improving the resolution of the camera.

The illustrated detector 4 is comprised for example of sixteen separate horn antenna providing a two-colour, eight pixel array. The size of the aperture of the detector 4 required to generate images at terahertz frequencies is such that the spacing between the individual horn antennae is limited to approximately 2.5 mm in the illustrated example. This spacing is not sufficient to enable the more conventional arrangement of the mixer at 90° to the local oscillator feed and so the detector aperture presents a limit to the number of antenna. However, by arranging the axis of the local oscillator input feed 17 so that it is substantially aligned with the axis of the antenna horn 14 and arranging the intersection of the axis of the mixer and the local oscillator feed 17 at 45° the number of detectors may be increased in the same area thereby improving the resolution of the detector.

It will, of course, be appreciated that whilst the illustrated arrangement of the mixer 16 and local oscillator feed 17 is preferred especially where the detector consists of an array of antennae in order to increase resolution, the terahertz imaging system describe herein is intended to also encompass more conventional arrangements of mixer and local oscillator feed.

Figure 7:
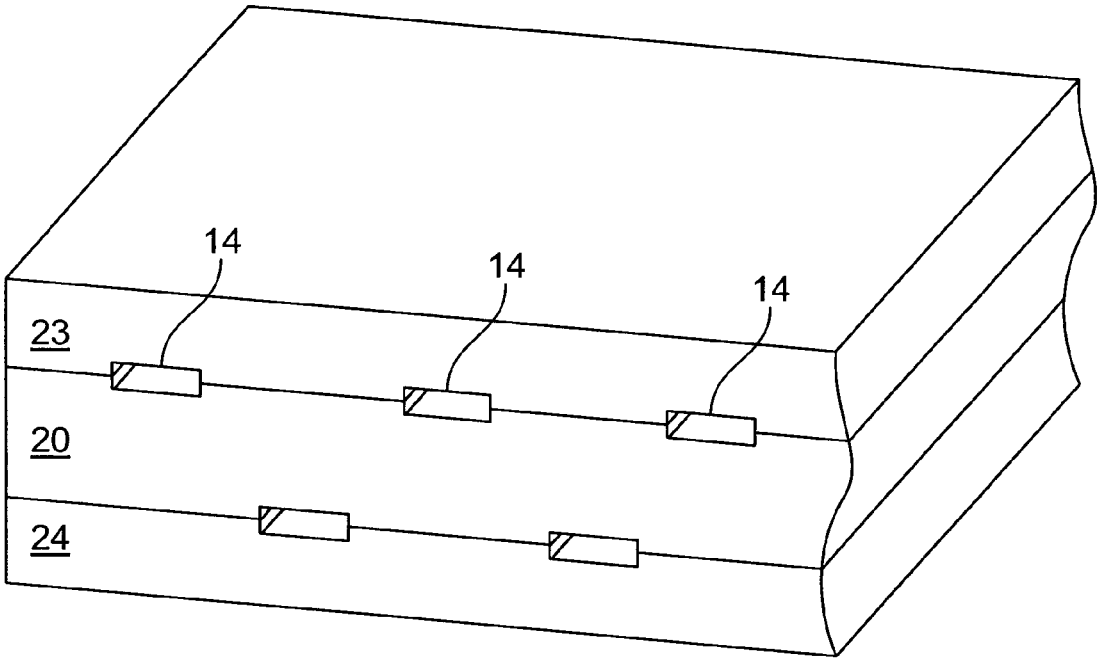
FIG. 7 is a perspective drawing of the three substrates shown in FIG.1.

As mentioned earlier, the detector 4 is fabricated from a semi conductor, e.g. silicon structure consisting of three separate etched layers: a top layer 23, a middle layer 20 and a lower layer 24 which are illustrated in FIG. 1 and FIG. 7. FIGS. 3 and 4 show the middle layer 20 which is etched on both its upper surface 21 and its lower surface 22. The upper layer 23 and the lower layer 24 are each etched on only one side and the pattern of the etch in each case is a mirror image of the etch pattern of the respective upper surface 21 and lower surface 22 of the middle layer 20. Thus, whilst for each individual layer of silicon the etch pattern is open, when the three layers are brought together, the etch patterns of their surfaces match to define waveguide structures extending along the interface of the surfaces. Co-operating location holes and pins 25 are also provided in the surfaces of each of the layers to ensure accurate positioning of the layers with respect to one another.

With reference to the middle layer 20, illustrated in FIGS. 3 and 4, eight separate horn antennae are shown on the upper surface 21 of the middle layer 20. In FIG. 4 the outline of a second row of eight horn antennae on the opposed lower surface 22 of the middle layer 20 can also been seen. Each horn antenna 14 is individually connected to its respective waveguide 15 and mixer 16. Individual local oscillator feeds 17 connect with respective mixers 16 but are themselves interconnected with one another upstream from the mixers to a single common local oscillator input 26. Thus, there are two separate local oscillator inputs 26, one for each surface of the middle layer 20 (for each set of eight antennae) and preferably, these two outputs 26 emerge at the edge of the middle layer 20 at different locations for ease of connection to the local oscillator source (not illustrated).

Figure 5:
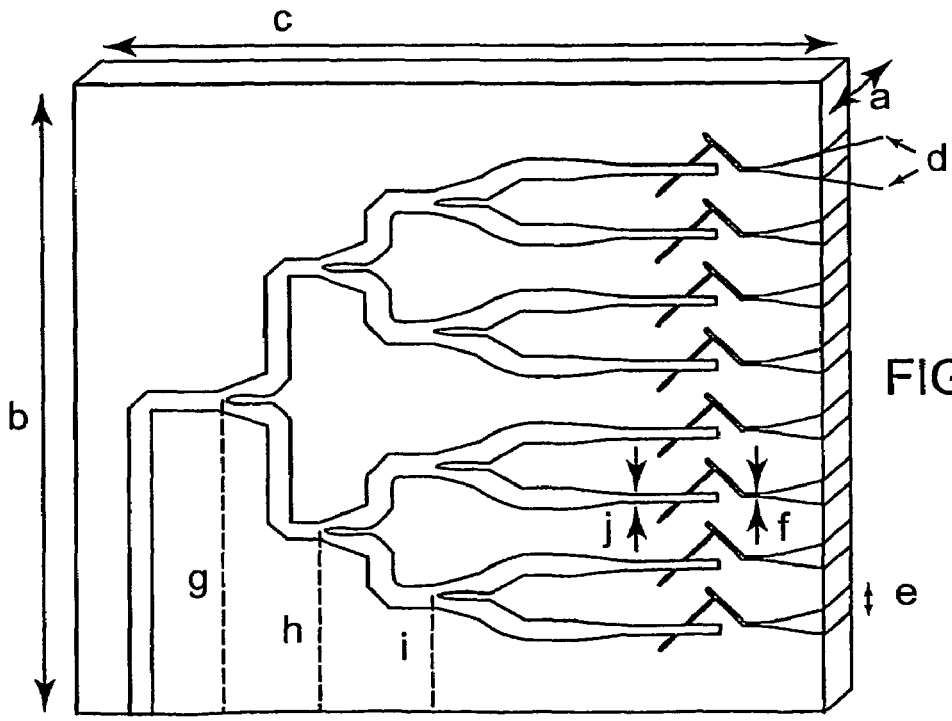
FIG. 5 is a line drawing of the waveguide structure of FIG. 2.

The dimensions of the etch pattern defining the waveguide structure are important to the functioning of the detector 4 and these dimensions can be determined though conventional modelling techniques. The detector illustrated in the figures is a two-colour detector with one of the set of eight antenna detecting a first terahertz frequency and the parallel second set of eight antenna detecting a second, different, terahertz frequency. This in turn requires the dimensions of the etch pattern for each of the two sets of eight antenna to differ slightly depending upon the frequencies of the input signal and the local oscillator signal. Moreover, to maximise structural strength, it can be seen in FIG. 4 that each row of horn antennae are offset from one another. The following measurements in relation to FIG. 5 are therefore provided solely to illustrate typical dimensions.

TABLE 1

| Element Structure | Antenna Row 1 (mm) | Antenna Row 2 (mm) |
|---|---|---|
| a - Layer thickness | 2.4 | 2.4 |
| b - Layer width | 25 | 25 |
| c - Layer length | 29 | 29 |
| d - Cone angle of horn | 23.5° | 27.7° |
| e - width of horn aperture | 0.78 | 1.04 |
| f - Width of signal input tuning circuit | 0.1 | 3 |
| g - distance of first branch of local oscillator feed from edge | 12.74 | 11.62 |
| h - distance of second branch of local oscillator feed from edge | 7.86 | 6.62 |
| i - distance of third branch of local oscillator feed from edge | 5.36 | 4.42 |
| j - Width of local oscillator feed adjacent mixer | 0.39 | 0.43 |

Downstream of the mixer 16, the IF output for each antenna passes to an outer surface of the silicon layered structure along a wire extending through a respective via 27. Thus a series of eight IF output vias extend through the body of the top silicon layer 23 and a corresponding series of eight IF output vias extend through the body of the bottom silicon layer 24. From there the IF outputs pass through a conventional series of 2 stage amplifiers 28 to an integrated detector 29 and from there to the data input port of the processor 5.

For detection of passive radiation at 250 GHz, for example a local oscillator signal of 245 GHz may be used to extracted an IF signal at 5 GHZ. It is to be understood that the frequencies quoted above are one illustration only and that conventional heterodyne theory can be employed to identify other suitable local oscillator frequencies and IF frequencies.

With the detector described above, passive radiation at terahertz frequencies can be detected at room temperature and the use of a heterodyne receiver ensures a spectrally specific and sensitive detector. Although a two-colour eight pixel array is described, it is immediately apparent that a single antenna terahertz camera comprising only two layers of patterned silicon may be implemented in the manner described above. Moreover, further layers of patterned silicon may be added with in each case the common local oscillator input 26 being located at different positions along the periphery of the silicon layers. However, where more than two rows of antenna are provided, the IF output vias must pass through intermediate silicon layers, avoiding the waveguide structure of that layer, and so the patterning of the antennae for different antennae rows should be offset from each other.

Of course, the number of antennas in a row may be different from 8, and there may be more than 8 antennas in a row.

Furthermore, it is envisaged that rather than using a slab of metallized intrinsic silicon or metal for the fabrication of the individual waveguide structures, the antennae may be fabricated in photonic bandgap material. This would prevent signal leakage between adjacent antennae and could provide an alternative structure for the mixer and for the conduction of both the signal input, the local oscillator LO signal and the intermediate frequency IF output.

Figure 6A:
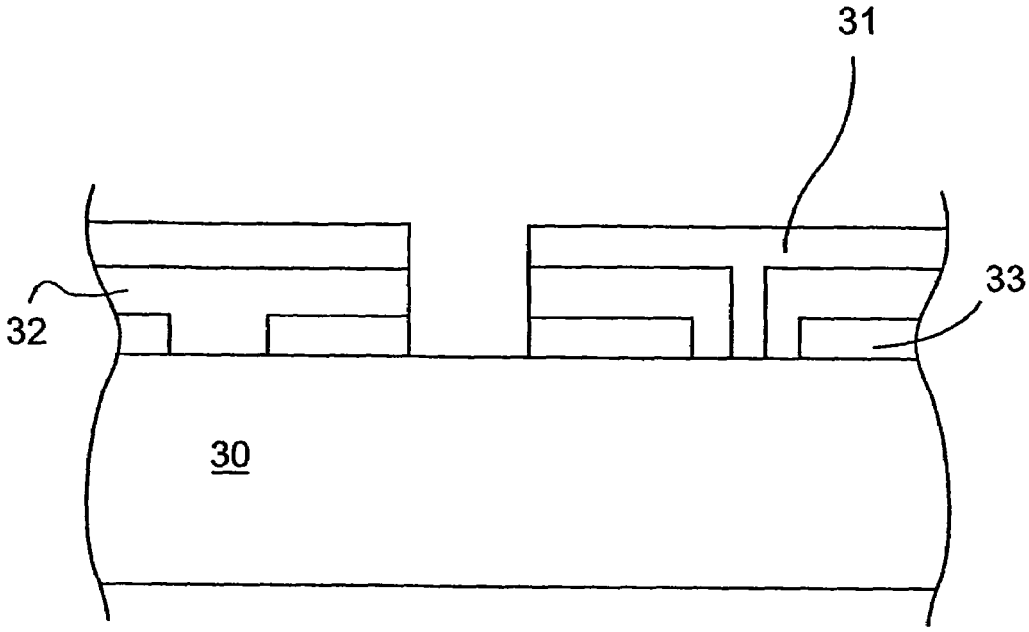
FIGS. 6*a*, 6*b*, 6*c* and 6*d* illustrates the fabrication steps for manufacture of the waveguide structure of FIGS. 2 and 3.

The waveguide structure described above requires etching of the individual silicon layers and a novel method of fabricating these structures is described below. With reference to FIG. 6*a* a silicon substrate 30 is illustrated on the upper surface of which is provided a series of three masks 31, 32 and 33 each laid on top of the next and in direct contact with the adjacent mask. In order from the top the first uppermost mask 31 is a positive resist or a metal mask. Directly beneath the first mask is a second negative resist mask 32 such as SU8 or other suitable amide mask material. Beneath the second mask is a third mask 33 preferably of silicon dioxide or aluminium nitride. The first mask 31 defines the deepest structures in the substrate and protects other areas from early etching. The second mask exposes, in addition to the deepest etch regions, intermediate depth etch regions whilst protecting those regions of the substrate that require the shallowest etch. The third and final mask exposes all areas previously etched as well as those areas requiring the shallowest etch. It is worth noting that the masks are not necessarily laid one on top of the next, but may be brought separately.

Figure 6B:
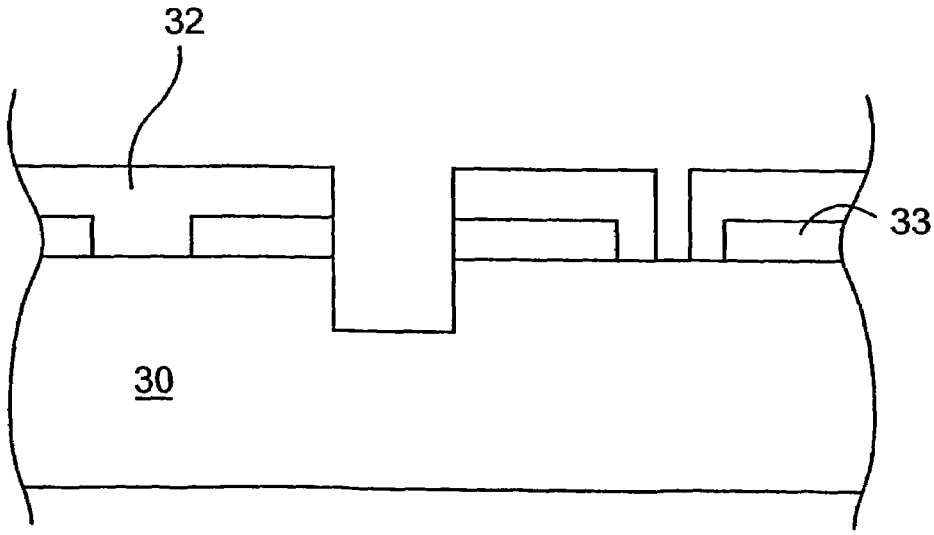
Figure 6C:
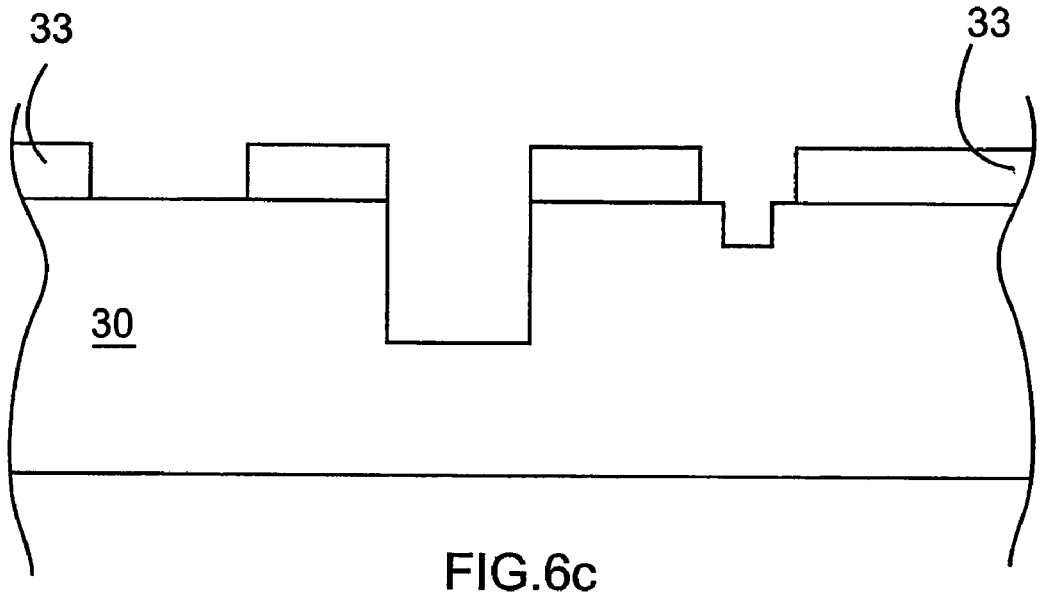
Figure 6D:
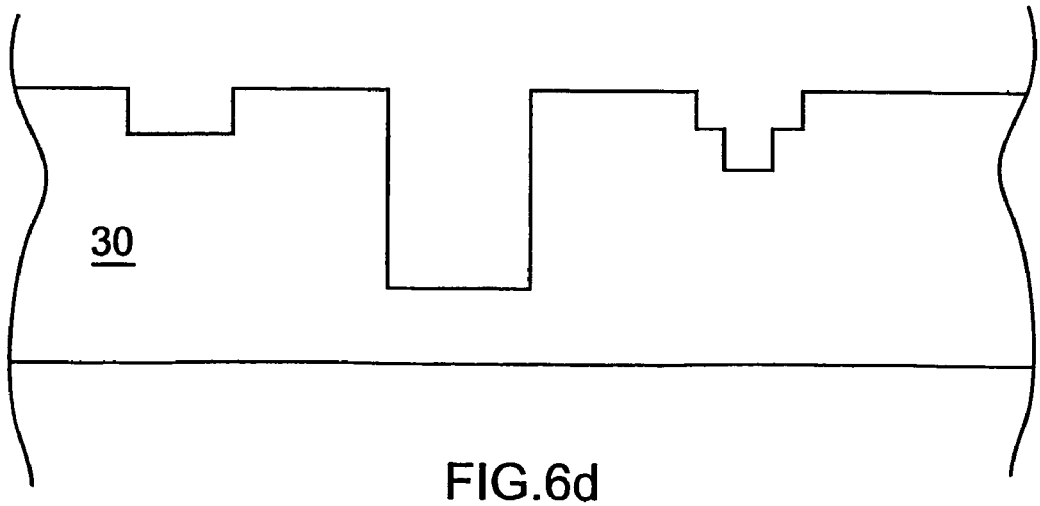

With regard to the waveguide structure described above, the deepest etches are patterned for the horn antennas 14 and the waveguides 15, the intermediate etch depth is required for the majority of the local oscillator waveguide structure and then the shallowest etching is required for the mixer channel. Once all of the individual masks have been applied, the first etch is performed using the positive resist mask 31. The etch is continued to an etch depth equivalent to the difference between the desired final depth of the deepest structures and the final depth of the intermediate structures. The positive resist mask 31 is then removed (FIG. 6*b*) using a normal stripper such as an amine type stripper which does not affect the underlying negative resist mask 32. The next etch stage is then performed through the SU8 mask 32 to a depth equivalent to the difference between the desired final depth of the intermediate structures and the shallowest structures. As the etched pattern from the first etch stage remain exposed this pattern is again etched and the pattern driven deeper into the substrate. Once the second etch is completed the second mask 32 is removed (FIG. 6*c*) which does not affect the underlying third mask 33 and then the third and final etch stage can be performed during which the shallowest features of the pattern are etched and the existing pattern again etched more deeply into the substrate 30 to its final depth. The third mask 33 is then removed (FIG. 6*d*). This procedure differs from then conventional procedure as it involves the use of a plurality of different masks each directly overlying an adjacent mask and an etching procedure in which new masks are not applied to the surface of the wafer in between etching steps.

Afterwards, the silicon is metallised in the desired regions (waveguides and vias)

Although reference has been made herein to the use of a convention X-Y stage for scanning a specimen by means of a static terahertz camera and mobile scanning optics it will, of course, be apparent that alternatives to this arrangement are envisaged. For example, the specimen may be mounted on an X-Y stage and moved so that different areas of the specimen are scanned in turn.

Alternatively, scanning may be performed wholly electronically through adjustment of the phase of the local oscillator input. In this regard a phase shifter may be introduced into the individual local oscillator feeds 17. As is known, the phase shifter is comprised of a waveguide which has a slab of high resistivity intrinsic silicon mounted on the inside of one wall of the waveguide. The slab of silicon is exposed to incident light which causes the silicon to exhibit resistive and/or metallic properties. The power of the incident light determines the depth to which the changes in the silicon penetrate, changing the dimensions of the waveguide and thereby its dispersion characteristics.

The imaging device described herein is suitable for the detection of passive millimeter and sub-millimeter electromagnetic radiation and in this respect is particularly convenient in view of its compact size, potential for portability and its ability to perform at room temperature. Thus, immediate applications for the imaging device are envisaged in both airborne and land vehicles, in security systems, in the chemical and food industries and in medical diagnostics. However, the scope of applications is not limited to those identified above and because of the low power requirements of the imaging system, it is particularly suited for example to imaging from space.

It will, of course, be apparent that alternative components and alternative manufacturing techniques may be employed without departing from the scope of the present invention as defined in the appended claims.

The invention claimed is:

1. An imaging device to be used with millimeter and/or sub-millimeter radiation comprising at least a pair of substrates, at least one of which is patterned on at least one surface with a patterning defining at least one radiation detector, each radiation detector comprising:

an antenna adapted to receive millimeter and/or sub-millimeter electromagnetic radiation, a mixer channel coupled to said antenna and in communication with a via extending through the substrate for connection to a signal output, a mixer comprising filters being mounted in the mixer channel for extracting an intermediate frequency signal in dependence upon said radiation received by the antenna, a waveguide structure coupled to said mixer and having a signal input for connection to a local oscillator, wherein the mixing channel intersects the local oscillator waveguide at an acute angle.

2. An imaging device as in claim 1, wherein each substrate of the said pair of substrates is patterned on at least one surface with co-operable patterning defining in combination said radiation detector.

3. The imaging device as in claim 1, wherein said patterning defines a plurality of radiation detectors.

4. The imaging device as in claim 1, wherein it comprises at least a third substrate, said three substrates defining two rows of radiation detectors.

5. The imaging device as in claim 1, wherein the antenna is comprised of a horn antenna (14) and of an antenna waveguide (15) that is coupled to said horn antenna (14) and that intersects the mixing channel at an angle of 90°.

6. The imaging device as in claim 5, wherein the antenna waveguide is offset from the horn antenna axis by an acute angle.

7. The imaging device as in claim 6, wherein the local oscillator waveguide is parallel to the horn antenna axis.

8. A process for making an imaging device according to any one of the preceding claims, comprising the following steps:

providing on a surface of a substrate a first (31), a second (32) and a third patterned masks (33), said first mask (31) having a first pattern corresponding to a first region of each radiation detector with the highest etch depth, said second mask (32) having a second pattern corresponding to said first region and to a second region of each radiation detector with an intermediate etch depth, and said third mask (33) having a third pattern corresponding to said first and second regions and to a third region of each radiation detectors with the shallowest etch depth, performing a first etch through the first pattern of the first mask (31) at a first depth that is substantially equal to the difference between the highest etch depth and the intermediate etch depth, removing said first mask (31), performing a second etch through the second pattern of the second mask (32) at a second depth that is substantially equal to the difference between the intermediate etch depth and the shallowest etch depth, removing said second mask (32), performing a third etch through the third pattern of the third mask (33) with an etch depth that is substantively equal to the shallowest etch depth.

9. A process as in claim 8, wherein said first (31), second (32) and third (33) masks are each laid on top of the next and in direct contact with the adjacent mask.

10. A process as in claim 9, wherein one of said masks (31, 32, 33) is a positive resist, or a metal mask, wherein another mask is a negative resist mask or an amide mask, and yet another mask is of silicon dioxide or aluminum nitride.

11. A process as in claim 9, wherein said first region corresponds to said antenna.

12. A process as in claim 9, wherein said second region corresponds to at least part of said waveguide structure.

13. A process as in claim 9, wherein said third region corresponds to said mixer channel.

* * * * *